US008201971B2

(12) United States Patent
Chen

(10) Patent No.: US 8,201,971 B2
(45) Date of Patent: Jun. 19, 2012

(54) MULTIPLE LED BULB WITH THERMAL MANAGEMENT FEATURES

(75) Inventor: Chi Gon Chen, Guang Zhou (CN)

(73) Assignee: International Development LLC, Roanoke, TX (US)

( * ) Notice: Subject to any disclaimer, the term of this patent is extended or adjusted under 35 U.S.C. 154(b) by 266 days.

(21) Appl. No.: 12/763,862

(22) Filed: Apr. 20, 2010

(65) Prior Publication Data

US 2011/0255280 A1 Oct. 20, 2011

(51) Int. Cl.
*F21S 4/00* (2006.01)
*F21V 21/00* (2006.01)

(52) U.S. Cl. ..... 362/249.02; 362/311.02; 362/545; 362/800

(58) Field of Classification Search ..... 362/249.02, 362/311.02, 545, 800
See application file for complete search history.

(56) References Cited

U.S. PATENT DOCUMENTS 7,699,501 B2 * 4/2010 Liu ..... 362/294
2010/0264799 A1 * 10/2010 Liu et al. ..... 313/46

* cited by examiner

*Primary Examiner* — Jason Moon Han
(74) *Attorney, Agent, or Firm* — Brian Harris

(57) ABSTRACT

An LED bulb assembly device having thermal management features. The device and methods for its manufacture are provided. The device consists of a machined base element that accepts a circuit board, a divider element, a heatsink element, and an LED assembly. The LED assembly includes a plurality of LEDs, but typically nine or eighteen. A reflector element encloses the internal components by positively engaging the base element. External electrical contact pins provide for electrical engagement with a compatible decorative lighting fixture.

13 Claims, 4 Drawing Sheets

MULTIPLE LED BULB WITH THERMAL MANAGEMENT FEATURES

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

1. Field of the Invention

The present invention relates to light bulbs, and more specifically, to light bulbs that utilize high-output light emitting diodes (LEDs).

2. Description of Related Art including information disclosed under 37 CFR 1.97 and 1.98

Given the energy concerns faced by consumers today, the trend has been to shift away from energy wasting lighting fixtures containing incandescent bulbs to those incorporating solid state devices such as light emitting diodes (LED). However, to achieve the same luminosity as the incandescent light being replaced requires use of multiple high-brightness LEDs. Further, to achieve the high-brightness associated with solid state LEDs requires relatively high electrical currents. As a consequence, lighting fixtures containing multiple high-brightness LEDs often experience thermal extremes that can lead to physical burns and hardware degradation.

BRIEF SUMMARY OF THE INVENTION

A multiple LED bulb device with thermal management features, the LED bulb device for installation in a decorative lighting fixture, the device comprising: an LED assembly including a plurality of LEDs affixed to a rigid mounting base such that all like-polarity LED leads are in electrical communication; a heatsink element made from a heat conductive material and including an inner receiving cavity for receiving the LED assembly, wherein the heatsink element is in thermal contact with the LED assembly; a circuit board element containing power conditioning circuitry for providing appropriate electrical power to the LED assembly, the circuit element including a rigid circuit board; a divider element for maintaining physical separation between the heatsink element and the circuit board element; an electrically conductive bridging device for supplying appropriately polarized power to the LED assembly from the circuit board element; a base element made from a rigid material and including an inner receiving cavity for receiving the circuit board element, the divider element, and the heatsink element; and at least two electrical contact pins in electrical contact with the circuit board element; and a reflector element including a defined retention feature for engaging a suitable mating feature on the base element A method of manufacturing a multiple LED bulb device with thermal management features, the LED bulb device for installation in a decorative lighting fixture, the method steps comprising: providing an LED assembly that includes a plurality of LEDs affixed to a rigid mounting base such that all like-polarity LED leads are in electrical communication; providing a heatsink element made from a heat conductive material and including an inner surface for accepting the LED assembly; providing a divider element; providing a circuit element capable of providing appropriate electrical power to drive the LEDs of the LED assembly; providing an electrically conductive bridging device for supplying appropriately polarized power to the LED assembly from the circuit element; providing a base element made from a rigid material and including an inner surface for accepting the circuit element, the divider element, and the heatsink element; providing at least two contact pins in electrical contact with the circuit element, the pins for mating with a lighting fixture socket; and providing a reflector element including defined retention features for engaging the foundation element and reflective facets for influencing the pattern of light emanating from the energized LEDs.

A method of manufacturing a multiple LED bulb device with thermal management features, the LED bulb device for installation in a decorative lighting fixture, the method steps comprising: installing a circuit board element containing LED power conditioning circuitry within the inner receiving cavity of a base element; installing a divider element within the inner receiving cavity of the base element such that the divider element contacts the circuit board element surface opposite the side in contact with the base element; installing an LED assembly within the inner receiving cavity of a heatsink element such that the LED assembly is in thermal contact with the heatsink element; installing the heatsink element within the inner receiving cavity of the base element such that the divider element is in contact with the surface of the heatsink element opposite that of the heatsink element receiving cavity; connecting the circuit board element to the LED assembly such that the circuit board element circuitry is in electrical continuity with the LED assembly; installing two electrical contact pins in the base element such that the contact pins protrude beyond the bottom surface of the base element, wherein the contact pins are in electrical continuity with the circuit board element LED power conditioning circuitry; and installing a reflector element over the heatsink element such that defined retention features in the reflector element positively engage suitable mating features on the base element for positive retention of the reflector element and enclosure of the LED bulb device.

This summary is not intended to limit the scope of the invention to any particular described embodiment or feature. It is merely intended to briefly describe some of the key features to allow a reader to quickly ascertain the subject matter of this disclosure. The scope of the invention is defined solely by the claims when read in light of the detailed disclosure.

BRIEF DESCRIPTION OF THE SEVERAL VIEWS OF THE DRAWING(S)

The present invention will be more fully understood by reference to the following detailed description of the preferred embodiments of the present invention when read in conjunction with the accompanying drawings, wherein.

Figure 1:
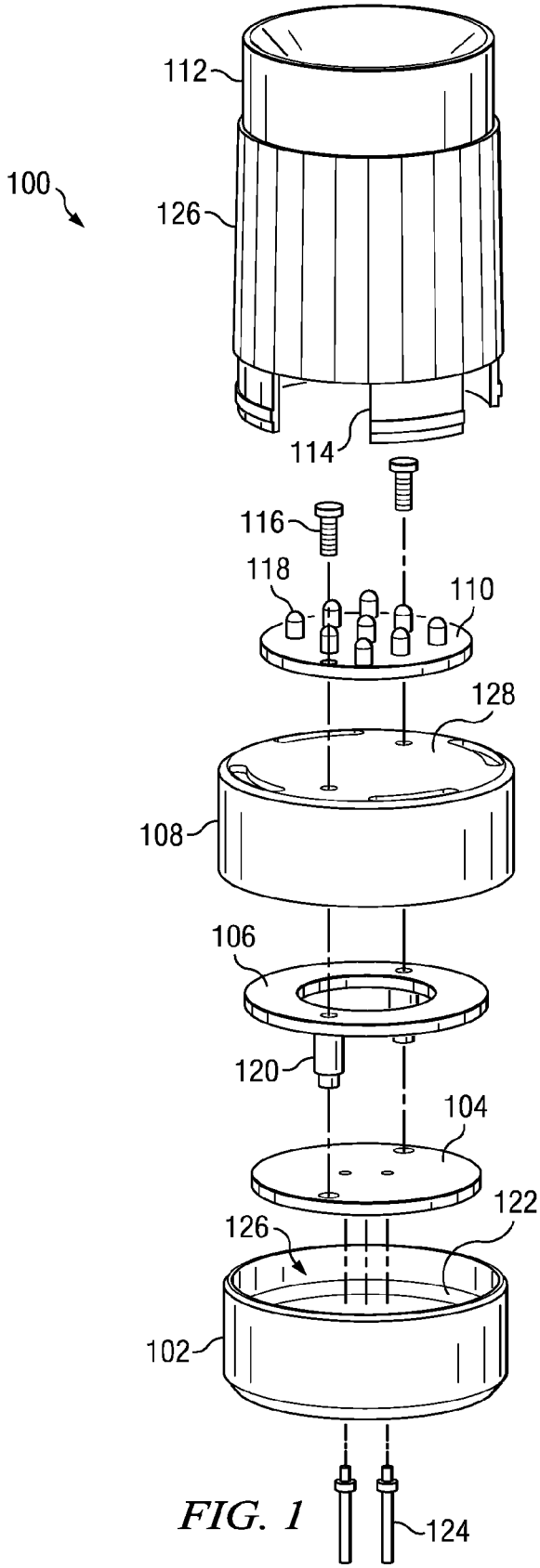
FIG. 1 is an exploded view of a 9-LED bulb assembly.

The above figures are provided for the purpose of illustration and description only, and are not intended to define the limits of the disclosed invention. Use of the same reference number in multiple figures is intended to designate the same or similar parts. Furthermore, when the terms "top," "bottom," "first," "second," "upper," "lower," "height," "width," "length," "end," "side," "horizontal," "vertical," and similar terms are used herein, it should be understood that these terms have reference only to the structure shown in the drawing and are utilized only to facilitate describing the particular embodiment. The extension of the figures with respect to number, position, relationship, and dimensions of the parts to form the preferred embodiment will be explained or will be within the skill of the art after the following teachings of the present invention have been read and understood.

DETAILED DESCRIPTION OF THE INVENTION

The decorative LED bulb of the present invention is provided in a first and second embodiment employing a 9-LED and a 18-LED configuration, respectively. The number of LEDs chosen is dependent upon the lighting requirements of the decorative lighting fixture within which the bulb operates.

FIG. 1 depicts a first embodiment of the present invention in exploded detail to highlight the individual elements. As shown in this figure, a base element (102) and a reflector element (112) are provided to form the outer body of the LED bulb assembly (100). This outer body is constructed of weather resistant materials to protect the internal components of the bulb.

The reflector element (112) in the present embodiment is constructed from clear plastic material and is cylindrical in shape. Although the present embodiment is clear plastic, other embodiments may utilize translucent plastic, glass, translucent glass, or any other suitable material that allows light to pass through. Further, the reflector may utilize a combination of glass and plastic, and may also utilize reflective coatings on an inner surface to reflect light through only a portion of the lens.

At the base of the reflector element are multiple retention features (114) for positively engaging the base element (102). Each retention feature (114) is a segmented tab formed from the lens material, and featuring a raised ridge near the lowermost portion. Because the reflector element is plastic, use of segmented tabs as depicted allows for a minimal amount of deflection of each tab when installing the reflector (112) into the base element (102). In another embodiment that utilizes glass for the reflector material, the retention feature is a solid ridge (i.e., no segments between tabs) around the lower portion of the enclosure element (112). Such arrangement provides support for the brittle glass body of the enclosure to prevent cracking during installation.

The body of the reflector element (112) also features a plurality of reflective facets (126) that serve to influence the distribution of the light pattern that emanates from the LED bulb assembly (100). One skilled in the art will appreciate that the facets may be evenly dispersed around the body of the reflector, may be clustered, or may be varied in size and shape depending upon the pattern of light desired. Still, other embodiments may use no facets at all to allow for maximum light transfer through the reflector lens.

The base element (102) is constructed of a rigid material, providing additional overall structural support to the LED bulb assembly for secure mounting in a suitable decorative lighting fixture. The base element (102) features an inner surface that is sized to form a cavity that is appropriate for accepting the internal contents of the bulb assembly. The inner surface also includes a grooved mating feature (122) within which the reflector element retention features (114) may engage. The base element (102) includes an inner receiving cavity (126) that is machined to a sufficient diameter and depth to contain the inner components of the LED bulb assembly.

In the present embodiment, the base element (102) is constructed from machined aluminum. This material is durable, relatively easy to machine, inexpensive, and may be anodized with various colors to match a decorative lighting fixture design. Aluminum also has a relatively high thermal conductivity to allow heat generated by the LEDs to be more readily dissipated. In other embodiments, however, it is possible to utilize different metals or polymers to construct the base (102).

The inner components of the LED bulb (100) include an LED assembly (110), a heatsink element (108), a divider element (106), and a circuit board element (104). The LED assembly of the present embodiment incorporates a plurality of high-brightness LEDs (118) that are wired together in a parallel configuration such that all like-polarity LED component leads are in electrical communication. The LEDs are then mounted on a conventional printed circuit board substrate using either surface mount soldering techniques or through-hole solder techniques. In the present embodiment the LED assembly (110) comprises nine such LEDs, while another embodiment (described in FIG. 3) comprises eighteen LEDs. Still, one skilled in the art will appreciate that any number of LEDs may be utilized, and that an increase in the number of LEDs results in a directly proportional increase in the operating temperature of the LED bulb assembly (100).

The heatsink element (108) is made from a material having a high thermal conductivity. In the present embodiment, the heatsink (108) is made from metal, preferably aluminum. The heatsink element (108) includes an flat surface (128) upon which the LED assembly (110) is installed. The LED assembly (110) physically contacts the heatsink inner surface such that the two are in thermal communication.

The present embodiment also includes a circuit board element (104) that provides power conditioning circuitry for powering the LED assembly (110). In this embodiment, the power conditioning circuitry is a constant current source that outputs the proper drive voltage and constant current for use by the LEDs to enable optimal generation of light. One of ordinary skill in the art will understand and appreciate that the type of power provided by the conditioning circuitry is wholly dependent upon the needs of the installed LEDs. For example, the Luxeon® K2 high-output LED (part number LXK2-PW14-U00) requires a constant current of 1000 mA for operation. Accordingly, the power conditioning circuitry would be designed such that it provided the constant 1000 mA of current regardless of the number of LEDs connected.

As shown, the circuit board element (104) of this embodiment is round in shape to approximate the shape of the base element (102). When installed in the base element receiving cavity (126), the circuit board element (104) engages the bottom of the cavity (126). Electrical insulation may be provided by an insulating material (such as a polymer sheet, a resinous compound, or anodizing of the surface) installed between the circuit and the base element surface.

A divider element (106) is next installed on top of the circuit board element (104) to electrically insulate the circuit board components and electrical traces from the heatsink element (108). In the present embodiment, the divider (106) features standoff devices (120) that allow the divider to physically prevent the heatsink (108) from contacting the circuit board element (104). The standoffs couple to corresponding penetrations in the circuit board (104) and hold the heatsink element (108) a fixed distance above the circuit board. Fastening devices (116) pass through the LED assembly (110), the heatsink (108), and the divider standoff devices (120) to physically engage the base element cavity (126) to retain the entire assembly within the base element (102). In another embodiment, the divider has no standoffs and lies flat against the outer edge of the circuit board element (104).

To provide a means for transmitting power, generated externally to the LED bulb assembly (100) for illumination to occur, two electrical contact pins (124) are provided. These pins (124) pass through the base element (102) and are in properly polarized electrical contact with the circuit board element (104). The pins in this embodiment pass perpendicular to the base element (102) bottom surface and are appropriately spaced to allow the overall LED bulb assembly (100) to fit within standard sockets on existing decorative lighting.

The power circuitry of the present embodiment consists of the electrical contact pins (124) being in electrical contact with the circuit board element (104) power conditioning circuitry. This circuitry is then in electrical contact with the LED assembly (110) through the use of a conductive device, such as wire leads, pins, conductive rivets, or screws that pass from the LED assembly (110) to the circuit board (104). An opening exists in the divider element (106) and the heatsink element (108) to allow for this configuration. The present embodiment utilizes conductive screws as this fastening device (116), allowing the sandwiched inner assembly to be sufficiently compressed such that electrical contact and thermal contact are established without undue compressive pressure on the circuit board (104). Still, in another embodiment the fasteners (116) are non-conductive screws, requiring an additional pair of conductive wires to allow power to pass from the circuit board (104) to the LED assembly (110) for operation of the LEDs.

Manufacture of the LED bulb assembly (100) of the present invention can be accomplished in a number of ways. However, it has been shown that one method of assembly for the LED bulb assembly (100) consist of the following steps: installing a circuit board element (104) containing LED power conditioning circuitry within the inner receiving cavity (126) of a base element (102); installing a divider element (106) within the inner receiving cavity of the base element (102) such that the divider element (106) contacts the circuit board element (104) surface opposite the side in contact with the base element (i.e., the top surface); installing an LED assembly (110) on top (128) of the heatsink element (108) such that the LED assembly (110) is in thermal contact with the heatsink element (108); installing the heatsink element (108) within the inner receiving cavity (126) of the base element (102) such that the divider element (106) is in contact with the appropriate penetrations on the circuit board (104); connecting the circuit board element (104) to the LED assembly such that the circuit board element (104) circuitry is in electrical continuity with the LED assembly (110); installing two electrical contact pins (124) in the base element (102) such that the contact pins (124) protrude beyond the bottom surface of the base element (102), wherein the contact pins (124) are in electrical continuity with the circuit board element (104) LED power conditioning circuitry; and installing a reflector element (112) over the heatsink element (108) such that defined retention features (114) in the reflector element (112) positively engage suitable mating features (122) on the base element (102) for positive retention of the reflector element (112) and establishment of the LED bulb assembly device (100).

Figure 2:
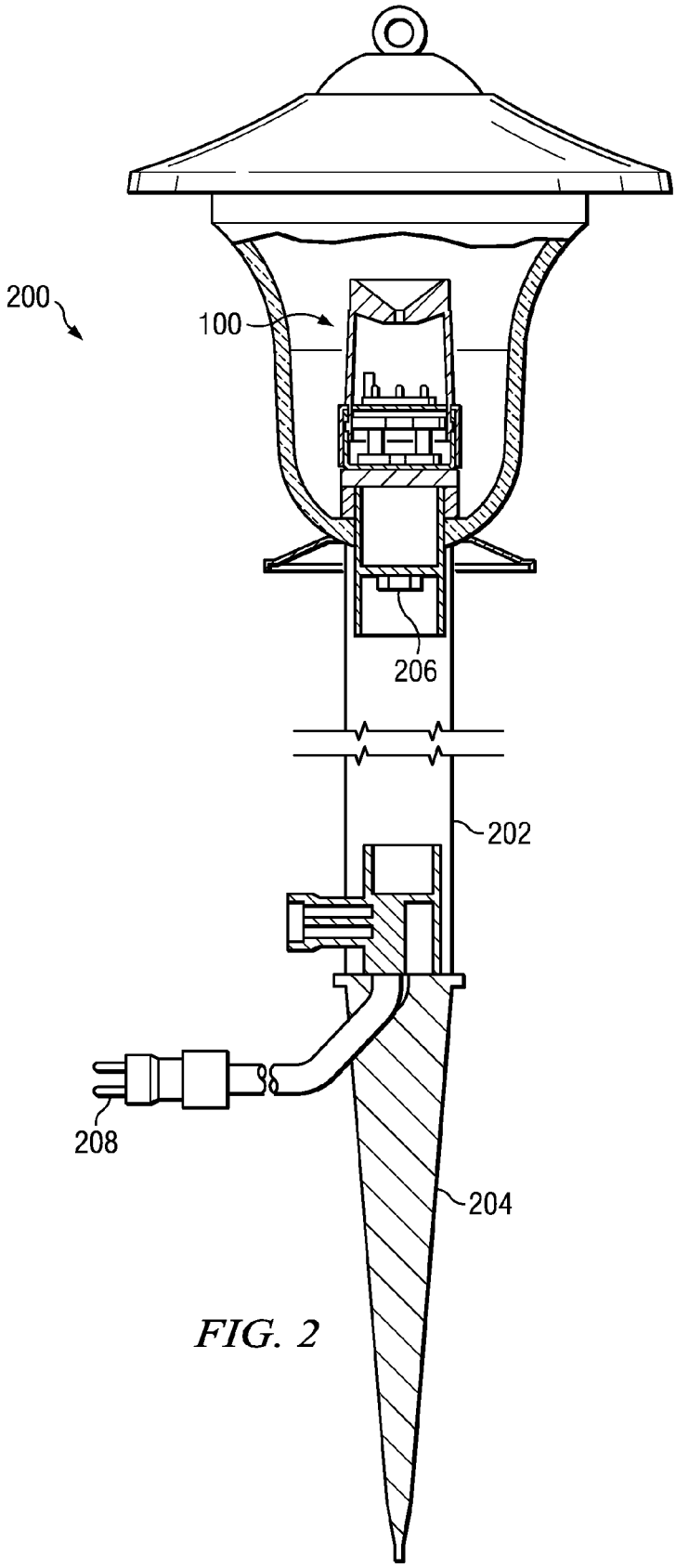
FIG. 2 is a cutaway depiction of an LED lighting fixture that utilizes the 9-LED bulb assembly.

FIG. 2 represents a depiction of an embodiment of a decorative lighting fixture (200) that incorporates the LED bulb assembly (100) to form a completed lamp. The LED bulb assembly (100) is engaged with the mating socket (206) of the fixture (200) such that the electrical contact pins (not shown, previously 124) are in electrical continuity with the socket connections. The lighting fixture (200) features a rigid column assembly (202) that houses the electrical wiring and external power connector (208) through which power is supplied by an external source (such as an AC or DC power supply. A surface penetration device (204) allows the fixture (200) to be installed, removed, and reinstalled in any number of locations in which the ground is penetrable.

Figure 3:
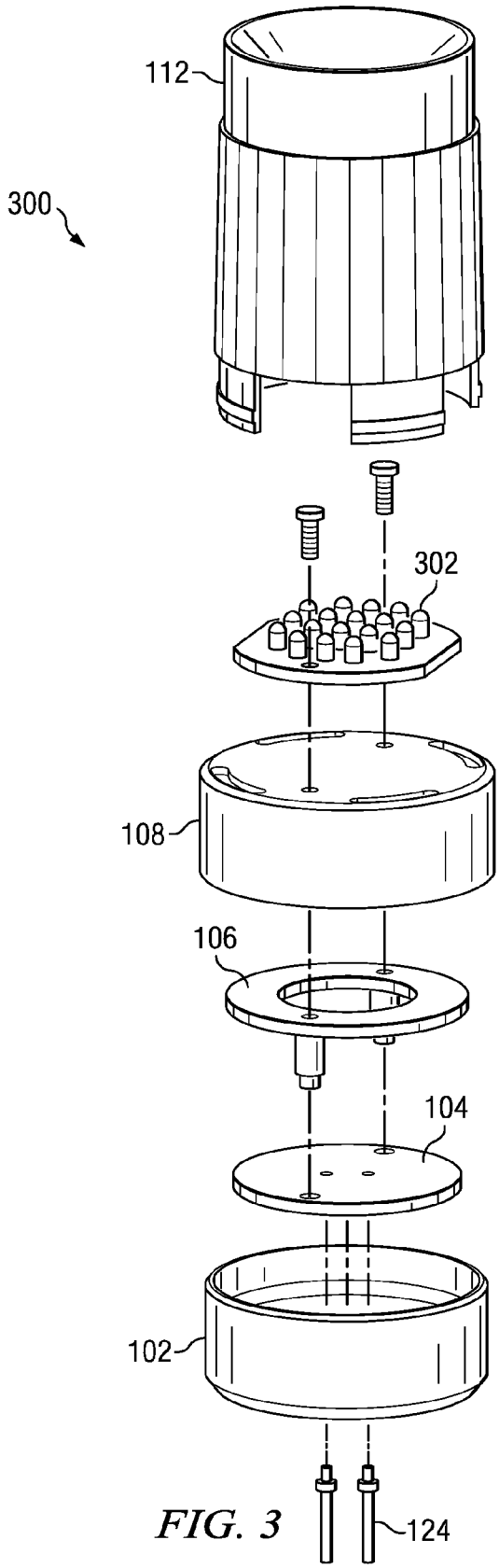
FIG. 3 is an exploded view of an 18-LED bulb assembly.

FIG. 3 depicts an exploded view of another embodiment of an LED Bulb Assembly (300) that utilizes an eighteen LED assembly (110). As shown in the previous embodiment, the invention comprises a base element (102), a circuit board element (104), a divider element (106), a heatsink element (108) and an LED assembly (302) having eighteen LEDs. The aforementioned components are assembled in the same fashion as the previous embodiment. Electrical contact pins (124) provide a means for applying external power to the LEDs, and a reflector assembly (112) completes the assembly (300). Because the number of LEDs is increased, there is a corresponding increase in the size and heat capacity of the heatsink element (108) to compensate. Additional LEDs requires additional drive power, which translates into sufficiently more power being dissipated within the LED bulb assembly (300). Therefore, the present invention design affords sufficient thermal-shedding capabilities due to the unique internal configuration of the assembly (300) and the surface area size of the heatsink (108).

Figure 4:
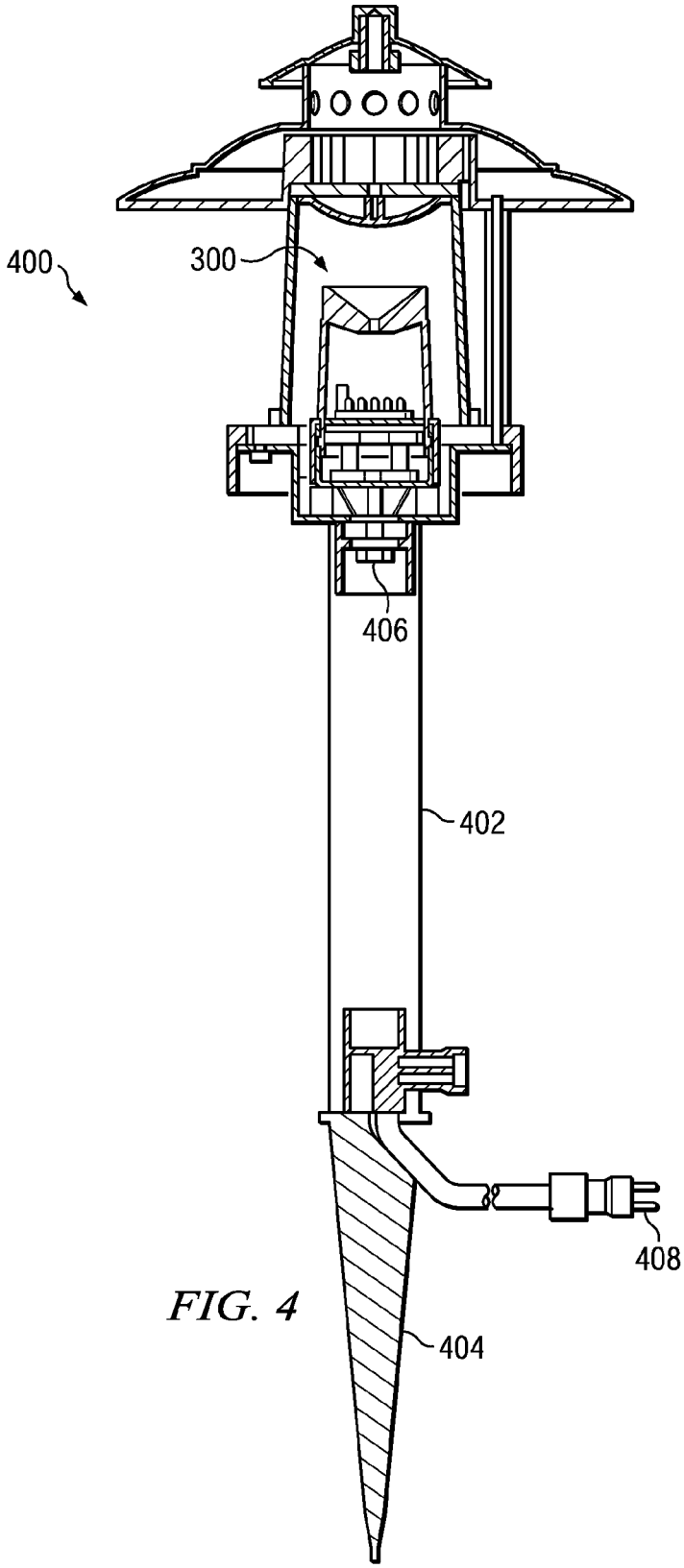
FIG. 4 is a cutaway depiction of an LED lighting fixture that utilizes the 18-LED bulb assembly.

FIG. 4 depicts yet another decorative lighting fixture (400) that utilizes the LED bulb assembly (300) as previously described. In this embodiment, a similar mating socket (406) is provided attached to a rigid column assembly (402) having a surface penetration device (404). External power is provided to the LED bulb assembly (300) through an external power connector (408) sized appropriately to provide the additional power necessary for the eighteen LED assembly (300).

A multiple LED bulb device with thermal management features, the LED bulb device for installation in a decorative lighting fixture, the device comprising: an LED assembly including a plurality of LEDs affixed to a rigid mounting base such that all like-polarity LED leads are in electrical communication; a heatsink element made from a heat conductive material and including an inner receiving cavity for receiving the LED assembly, wherein the heatsink element is in thermal contact with the LED assembly; a circuit board element containing power conditioning circuitry for providing appropriate electrical power to the LED assembly, the circuit element including a rigid circuit board; a divider element for maintaining physical separation between the heatsink element and the circuit board element; an electrically conductive bridging device for supplying appropriately polarized power to the LED assembly from the circuit board element; a base element made from a rigid material and including an inner receiving cavity for receiving the circuit board element, the divider element, and the heatsink element; and at least two electrical contact pins in electrical contact with the circuit board element; and a reflector element including a defined retention feature for engaging a suitable mating feature on the base element.

The device above wherein the divider element is electrically and thermally insulating.

The device above wherein the divider element comprises at least two standoff features, and the circuit board element features corresponding penetrations to allow the standoff features to extend beyond the circuit board element such that each standoff feature is in direct contact with the base element.

The device above further comprising at least one fastening device per standoff feature wherein each fastening device penetrates the LED assembly and engages the standoff device for positive retention of the LED assembly and heatsink element.

The device above wherein the reflector element comprises a plurality of reflective facets for influencing the pattern of light emanating from the energized LEDs.

The device above wherein the heatsink device is in thermal contact with the base element for transfer of heat from the heatsink element to the base element.

The device above wherein the LED assembly is comprised of either 9 or 18 high-brightness LEDs.

A method of manufacturing a multiple LED bulb device with thermal management features, the LED bulb device for installation in a decorative lighting fixture, the method steps comprising: providing an LED assembly that includes a plurality of LEDs affixed to a rigid mounting base such that all like-polarity LED leads are in electrical communication; providing a heatsink element made from a heat conductive material and including an inner surface for accepting the LED assembly; providing a divider element; providing a circuit element capable of providing appropriate electrical power to drive the LEDs of the LED assembly; providing an electrically conductive bridging device for supplying appropriately polarized power to the LED assembly from the circuit element; providing a base element made from a rigid material and including an inner surface for accepting the circuit element, the divider element, and the heatsink element; providing at least two contact pins in electrical contact with the circuit element, the pins for mating with a lighting fixture socket; and providing a reflector element including defined retention features for engaging the foundation element and reflective facets for influencing the pattern of light emanating from the energized LEDs.

A method of manufacturing a multiple LED bulb device with thermal management features, the LED bulb device for installation in a decorative lighting fixture, the method steps comprising: installing a circuit board element containing LED power conditioning circuitry within the inner receiving cavity of a base element; installing a divider element within the inner receiving cavity of the base element such that the divider element contacts the circuit board element surface opposite the side in contact with the base element; installing an LED assembly within the inner receiving cavity of a heatsink element such that the LED assembly is in thermal contact with the heatsink element; installing the heatsink element within the inner receiving cavity of the base element such that the divider element is in contact with the surface of the heatsink element opposite that of the heatsink element receiving cavity; connecting the circuit board element to the LED assembly such that the circuit board element circuitry is in electrical continuity with the LED assembly; installing two electrical contact pins in the base element such that the contact pins protrude beyond the bottom surface of the base element, wherein the contact pins are in electrical continuity with the circuit board element LED power conditioning circuitry; and installing a reflector element over the heatsink element such that defined retention features in the reflector element positively engage suitable mating features on the base element for positive retention of the reflector element and enclosure of the LED bulb device.

The method steps above further comprising: compressing the LED assembly against the heatsink element through the use of a retention device that extends from the LED assembly to the circuit board element.

The method above wherein the divider element comprises at least two standoff features, and the circuit board element features corresponding penetrations to allow the standoff features to extend beyond the circuit board element such that each standoff feature is in direct contact with the base element.

The method above, the method steps further comprising: installing at least one fastening device per standoff feature wherein each fastening device penetrates the LED assembly and engages the standoff device for positive retention of the LED assembly and heatsink element.

The method above wherein the reflector element comprises a plurality of reflective facets for influencing the pattern of light emanating from the energized LEDs.

The method above wherein the heatsink device is in thermal contact with the base element for transfer of heat from the heatsink element to the base element.

The method above wherein the LED assembly is comprised of either 9 or 18 high-brightness LEDs.

The invention may be embodied in other specific forms without departing from the spirit or essential characteristics thereof. The present embodiments are therefore to be considered in all respects as illustrative and not restrictive. Accordingly, the scope of the invention is established by the appended claims rather than by the foregoing description. While various alterations and permutations of the invention are possible, the invention is to be limited only by the following claims and equivalents.

I claim:

1. A multiple LED bulb device with thermal management features, the LED bulb device installed in a decorative ground lighting fixture, the device comprising:

an LED assembly including a plurality of LEDs affixed to a rigid mounting base such that all like-polarity LED leads are in electrical communication;

a heatsink element made from a heat conductive material for receiving the LED assembly, wherein the heatsink element is in thermal contact with the LED assembly;

a circuit board element containing power conditioning circuitry for providing appropriate electrical power to the LED assembly, the circuit element including a rigid circuit board;

a divider element for maintaining physical separation between the heatsink element and the circuit board element;

a base element made from a rigid material and including an inner receiving cavity for receiving the circuit board element, the divider element, and the heatsink element;

at least two electrical contact pins in electrical contact with the circuit board element; and a reflector element including a defined retention feature for engaging a suitable mating feature on the base element;

wherein the divider element comprises at least two standoff features, and the circuit board element features corresponding penetrations to allow the standoff features to extend beyond the circuit board element such that each standoff feature is in direct contact with the base element and the heatsink element.

2. The device of claim 1 wherein the divider element is electrically and thermally insulating.

3. The device of claim 1 further comprising at least one fastening device per standoff feature wherein each fastening device penetrates the LED assembly and engages the standoff device for positive retention of the LED assembly and heatsink element.

4. The device of claim 1 wherein the reflector element comprises a plurality of reflective facets for influencing the pattern of light emanating from the energized LEDs.

5. The device of claim 1 wherein the heatsink device is in thermal contact with the base element for transfer of heat from the heatsink element to the base element.

6. The device of claim 1 wherein the LED assembly is comprised of either 9 or 18 high-brightness LEDs.

7. A method of manufacturing a multiple LED bulb device with thermal management features, the LED bulb device installed in a decorative ground lighting fixture, the method steps comprising:

providing an LED assembly that includes a plurality of LEDs affixed to a rigid mounting base such that all like-polarity LED leads are in electrical communication;

providing a heatsink element made from a heat conductive material for accepting the LED assembly;

providing a divider element;

providing a circuit element capable of providing appropriate electrical power to drive the LEDs of the LED assembly;

providing a base element made from a rigid material and including an inner surface for accepting the circuit element, the divider element, and the heatsink element;

providing at least two contact pins in electrical contact with the circuit element, the pins for mating with a lighting fixture socket; and providing a reflector element including defined retention features for engaging the base element and reflective facets for influencing the pattern of light emanating from the energized LEDs;

wherein the divider element comprises at least two standoff features, and the circuit element features corresponding penetrations to allow the standoff features to extend beyond the circuit element such that each standoff feature is in direct contact with the base element and the heatsink element.

8. A method of manufacturing a multiple LED bulb device with thermal management features, the LED bulb device installed in a decorative ground lighting fixture, the method steps comprising:

installing a circuit board element containing LED power conditioning circuitry within the inner receiving cavity of a base element;

installing a divider element within the inner receiving cavity of the base element such that the divider element contacts the circuit board element surface opposite the side in contact with the base element;

installing an LED assembly on a heatsink element such that the LED assembly is in thermal contact with the heatsink element;

installing the heatsink element within the inner receiving cavity of the base element such that the divider element is in contact with the surface of the heatsink element opposite that of the heatsink element receiving cavity;

connecting the circuit board element to the LED assembly such that the circuit board element circuitry is in electrical continuity with the LED assembly;

installing two electrical contact pins in the base element such that the contact pins protrude beyond the bottom surface of the base element, wherein the contact pins are in electrical continuity with the circuit board element LED power conditioning circuitry; and installing a reflector element over the heatsink element such that defined retention features in the reflector element positively engage suitable mating features on the base element for positive retention of the reflector element and enclosure of the LED bulb device;

wherein the divider element comprises at least two standoff features, and the circuit board element features corresponding penetrations to allow the standoff features to extend beyond the circuit board element such that each standoff feature is in direct contact with the base element and the heatsink element.

9. The method steps of claim 8 further comprising:

compressing the LED assembly against the heatsink element through the use of a retention device that extends from the LED assembly to the circuit board element.

10. The method of claim 8, the method steps further comprising:

installing at least one fastening device per standoff feature wherein each fastening device penetrates the LED assembly and engages the standoff device for positive retention of the LED assembly and heatsink element.

11. The method of claim 8 wherein the reflector element comprises a plurality of reflective facets for influencing the pattern of light emanating from the energized LEDs.

12. The method of claim 8 wherein the heatsink device is in thermal contact with the base element for transfer of heat from the heatsink element to the base element.

13. The device of claim 8 wherein the LED assembly is comprised of either 9 or 18 high-brightness LEDs.

* * * * *